US008746498B2

(12) United States Patent
Maldonado et al.

(10) Patent No.: US 8,746,498 B2
(45) Date of Patent: Jun. 10, 2014

(54) COOLERS WITH STORAGE HOOKS

(75) Inventors: John Ethan Maldonado, Katy, TX (US); James B. Duke, Katy, TX (US)

(73) Assignee: Igloo Products, Corp., Katy, TX (US)

( * ) Notice: Subject to any disclaimer, the term of this patent is extended or adjusted under 35 U.S.C. 154(b) by 0 days.

(21) Appl. No.: 13/478,845

(22) Filed: May 23, 2012

(65) Prior Publication Data

US 2012/0298672 A1 Nov. 29, 2012

Related U.S. Application Data

(60) Provisional application No. 61/489,480, filed on May 24, 2011.

(51) Int. Cl.
*B65D 25/28* (2006.01)
*F25D 3/08* (2006.01)

(52) U.S. Cl.
CPC ..... *B65D 25/2835* (2013.01); *F25D 3/08* (2013.01)
USPC ..... 220/756; 62/457.7; 248/211

(58) Field of Classification Search
CPC ..... B65D 25/2835; B65D 25/2852; B65D 25/32; F25D 3/08; A45C 11/20
USPC ..... 220/756, 915.2, 915.1; 248/211, 210; 62/457.7, 457.1
IPC ..... B65D 25/28
See application file for complete search history.

(56) References Cited

U.S. PATENT DOCUMENTS

| | | | | |
|---|---|---|---|---|
| 2,501,772 | A * | 3/1950 | Guard | 220/592.16 |
| 2,541,261 | A * | 2/1951 | Martinson | 294/68.1 |
| 3,152,729 | A | 10/1964 | Piker | |
| 3,467,562 | A | 9/1969 | Piker | |
| D306,545 | S | 3/1990 | Rosdick | |
| 5,806,817 | A | 9/1998 | Loud | |
| 2010/0032439 | A1 | 2/2010 | Kennedy | |

OTHER PUBLICATIONS

Blain R. Copenheaver, Patent Cooperation Treaty—International Search Report and the Written Opinion issued in Application No. PCT/US2012/039153, mailed Jul. 27, 2012, 8 pages.

* cited by examiner

*Primary Examiner* — Robert J Hicks
(74) *Attorney, Agent, or Firm* — King & Spalding LLP

(57) ABSTRACT

A cooler has a body that includes a bottom and at least one wall forming a cavity therein. The cooler can also include a lid rotatably or otherwise removably coupled to the wall of the body. The cooler also includes a spout provided in the lid for obtaining liquid stored in the cavity of the cooler body. The cooler also include a handle assembly rotatably coupled to either the lid or the body. The handle assembly include at least one handle arm having a first end rotatably coupled to either the lid or the body and a second, distal end coupled to a handle. One or more hook features are coupled to, rotatably coupled to, slidably disposed within, or generally provided with or adjacent to the handle.

24 Claims, 6 Drawing Sheets

COOLERS WITH STORAGE HOOKS

CROSS-REFERENCE TO RELATED APPLICATION

The present application claims priority under 35 U.S.C. §119(e) to U.S. Provisional Patent Application No. 61/489,480, titled "Coolers With Storage Hooks" filed on May 24, 2011, the entire disclosure of which is hereby fully incorporated herein by reference.

TECHNICAL FIELD

The present disclosure relates generally to containers having a means for storing or holding the container above the ground or a floor surface, and more particularly, to food and beverage coolers having storage hooks.

BACKGROUND

Food and beverage containers, such as personal coolers and beverage coolers or jugs, are typically used to store items that need to remain cool. During outdoor sports or recreational activities, such as baseball, football, track, etc, these coolers are typically stored on the ground or placed on the bench because there is no designated area to store the coolers for the players. Generally, storing the coolers on the ground or on the bench can result in the beverage jugs being accidentally knocked over. This can result in the exterior of the container, including the designated area from which fluid and/or other contents are to be obtained from the container, to get dirty and potentially contaminated. Furthermore, if leakage occurs, the area in which the cooler rests on the ground can become muddy or messy.

Therefore a need exists for a system that addresses the problems associated with conventional coolers used in outdoor areas.

SUMMARY

In general, in one aspect, the disclosure relates to a cooler. The cooler can include body having a bottom and at least one wall forming a cavity. The cooler can also include a lid removably coupled to the at least one wall. The cooler can further include a spout coupled to the lid. The cooler can also include a handle assembly coupled to the body. The handle assembly can include at least one handle arm having a distal end and a proximal end, where the distal end is coupled to the body. The handle assembly can also include a handle having a handle end coupled to the proximal end of the at least one handle arm. The handle assembly can further include at least one hook coupled to the handle.

In another aspect, the disclosure can generally relate to a cooler. The cooler can include a body having a bottom and at least one wall defining a cavity. The cooler can also include a lid removably coupled to the at least one wall. The lid can include a lid base. The lid can also include at least one handle arm having a distal end and a proximal end, where the distal end is coupled to the lid base. The lid can further include a handle having a handle end coupled to the proximal end of the at least one handle arm. The lid can also include at least one hook mechanically coupled to the handle.

In yet another aspect, the disclosure can generally relate to a cooler. The cooler can include a body having a bottom and at least one wall forming a cavity. The cooler can also include a lid removably coupled to the at least one wall. The cooler can further include a spout coupled to a lower portion of the body. The cooler can also include a handle assembly coupled to an upper portion of the body. The handle assembly can include at least one handle arm having a distal end and a proximal end, where the distal end is coupled to the upper portion of the body. The handle assembly can further include a handle having a handle end coupled to the proximal end of the at least one handle arm. The handle assembly can also include at least one hook coupled to the handle.

These and other aspects, objects, features, and embodiments will be apparent from the following description and the appended claims.

BRIEF DESCRIPTION OF THE DRAWINGS

The drawings illustrate only exemplary embodiments of coolers with storage hooks and are therefore not to be considered limiting of its scope, as the coolers with storage hooks may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF THE EXEMPLARY EMBODIMENTS

Figure 1A:
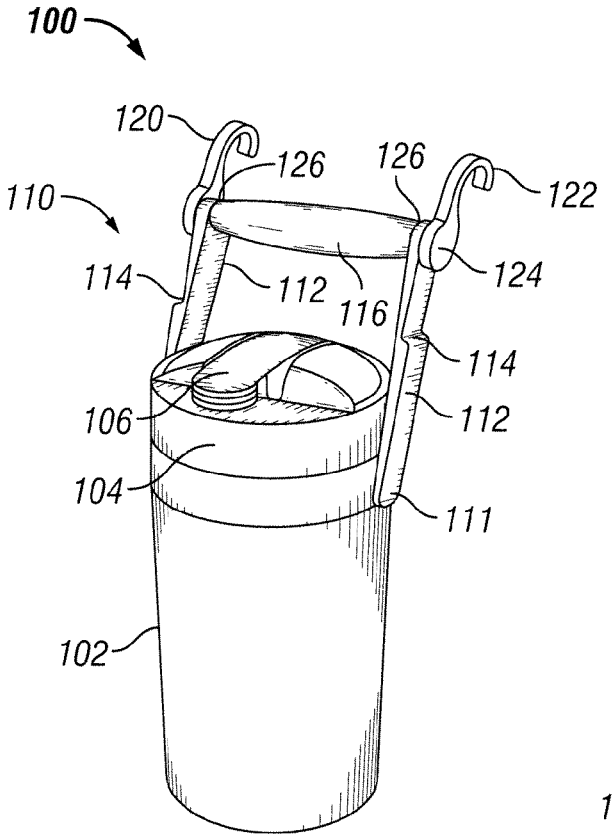
FIGS. 1A-1C are perspective views of an exemplary cooler with storage hooks in accordance with certain exemplary embodiments.

Exemplary embodiments of coolers with storage hooks will now be described in detail with reference to the accompanying figures. Like, but not necessarily the same or identical, elements in the various figures are denoted by like reference numerals for consistency. In the following detailed description of the exemplary embodiments, numerous specific details are set forth in order to provide a more thorough understanding of the disclosure herein. However, it will be apparent to one of ordinary skill in the art that the exemplary embodiments herein may be practiced without these specific details. In other instances, well-known features have not been described in detail to avoid unnecessarily complicating the description. As used herein, a length, a width, and height can each generally be described as lateral directions.

The exemplary storage hooks described herein are used to engage an object so that the cooler can hang. In such a case, the cooler avoids resting on the ground or some other surface that can introduce dirt, mud, grass, and/or other contaminants to the spout, handle, and/or other components of the cooler. In addition, by hanging the cooler using exemplary embodiments described herein rather than allowing the cooler to rest on the ground, the cooler avoids being tipped over by an accidental or incidental movement. Examples of such an object on which a cooler can hang include, but are not limited to, a fence (e.g., chain link fence, wooden fence, iron fence), a back of a chair (folding or otherwise), a baby stroller handle, a climbing frame, a playing structure (e.g., monkey bar, a slide frame), and a frame for bleachers.

The exemplary coolers used with the exemplary storage hooks have a number of characteristics. The cooler is an insulated container for storing food and/or beverages. In certain exemplary embodiments, the cooler used to store food and/or beverages is not insulated. The cooler has a body that includes a bottom and at least one wall that forms a cavity into which the food and/or beverages are stored. The cooler also has a lid (also called a cover) that is mechanically coupled to body of the cooler. The lid and body can be coupled in one or more of a number of ways, including but not limited to threadably, rotatably, hingedly, slidably, and removably. The body and lid of the cooler are made of one or more hard materials (e.g., plastic, metal), one or more soft materials (e.g., vinyl, nylon, polyester, neoprene), or any suitable combination thereof. The lid and body can be made of the same or different materials.

The contents of the cooler can be accessed in one or more of a number of ways. In one exemplary embodiment, the lid is removed to access the contents of the cooler. As another example, a spout is positioned on the lid and/or body of the cooler. In such a case, when the spout is engaged (e.g. moved from a first closed position to a second opened position whether by rotation or extension), the contents of the cooler can be accessed. The spout can be one or more of a number of types of spouts. Examples of types of spouts include, but are not limited to, a flip cap, a hole, a straw, and a spigot. The spout can be positioned at any location on the cooler, including but not limited to the lid and the base of the cooler body. In the case where the spout is a straw, the straw may be used to extract liquid from within the cooler. In such a case, the straw can traverse a hole in the lid and/or body of the cooler. The straw can be coupled to the cooler in one or more of a number of ways, including but not limited to fixedly and removably. Such a straw can be rigid and/or flexible, and the straw can be straight and/or curved.

Figure 1B:
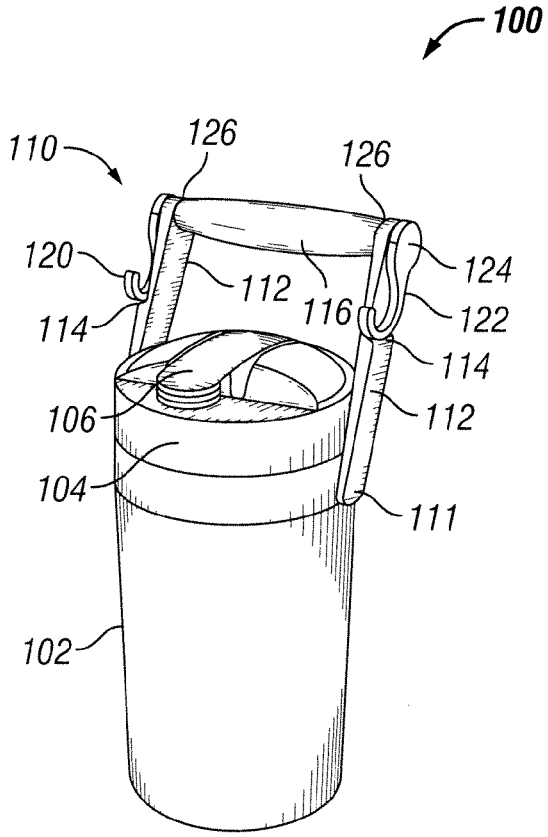
Figure 1C:
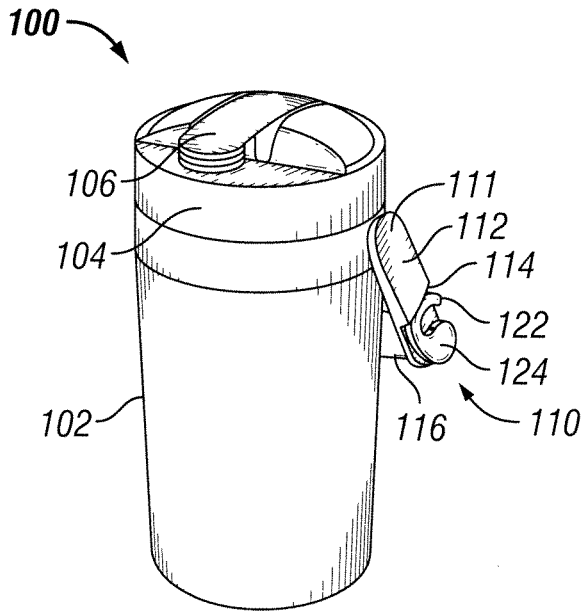

FIGS. 1A-C are perspective views of an exemplary cooler 100 with storage hooks 120, 122 in accordance with certain exemplary embodiments. The cooler includes a body 102, a lid 104 threadably coupled to the body 102, an optional spout 106 mechanically coupled to the lid 104, and a handle assembly 110 hingedly coupled to the body 102. The handle assembly 110 includes a number of components, including but not limited to at least one handle arm 112, a handle 116, and at least one hook (e.g., hook 120, hook 122).

The components of the handle assembly 110 can each be made of certain hard materials (e.g., plastic, metal), certain soft materials (e.g., vinyl, nylon, polyester, neoprene), or any suitable combination thereof Each component of the handle assembly 110 can be made of the same or different materials as the other components of the handle assembly 110. In addition, each component of the handle assembly can have the same or different colors as the other components of the handle assembly 110.

When a component of the handle assembly 110 is rotatably coupled to some other component (e.g., the body 102, the lid 104, another component of the handle assembly 110), the rotatable coupling is made using one or more of a number of methods including, but not limited to, a fastening device (e.g., screw, rivet, threadless bolt), a compression fitting, a snap fitting, a protrusion of one component positioned within an aperture of another component, and mating threads. The rotatable coupling can be removable, fixed to one of the components, and/or fixed to all components that are rotatably coupled.

When a component of the handle assembly 110 is fixedly coupled to some other component (e.g., the body 102, the lid 104, another component of the handle assembly 110), the fixed coupling is made using one or more of a number of methods including, but not limited to, a fastening device (e.g., screw, bolt), epoxy, fusion, welding, soldering, a compression fitting, a snap fitting, a protrusion of one component positioned within an aperture of another component, and mating threads. In addition, or in the alternative, the components that are described as being fixedly coupled above are integrally formed with one or more of the components as a single component. In certain exemplary embodiments, an overmold of a component is created by injecting the material of the component into an area of the fixed coupling of the components to form a stronger bond between the components that are fixedly coupled.

In certain exemplary embodiments, if the handle assembly 110 is mechanically coupled to the lid 104 rather than the base 102, the handle assembly 110 is part of the lid 104. In such a case, in certain exemplary embodiments, the handle arm of the handle assembly 110 is mechanically coupled to a base of the lid 104 (also called a lid base).

The exemplary handle arm 112 (two shown in FIGS. 1A-C) of the handle assembly 110 is mechanically coupled to the body 102. The handle arm 112 mechanically couples the body 102 (or some other portion of the cooler 100) to the handle 116. The handle arm 112 can have one or more of a number of shapes, sizes, and/or dimensions. For example, with regard to shapes, the handle arm 112 can be straight, curved, angled, or any suitable combination thereof. The handle arm 112 is mechanically coupled to a portion (e.g., the body 102, the lid 104) of the cooler 100 about an axis defined by a pivot point 111. A pivot point can be any point of coupling between at least two components, including but not limited to fixed, hinged, and rotatable. The handle arm 112 is mechanically coupled to the body 102 at any point along the handle arm 112 and/or along the body 102. In this example, the distal end of the handle arm 112 is rotatably coupled to the outer surface of the upper portion of the body 102 at pivot point 111. In certain exemplary embodiments, the handle arm 112 is mechanically coupled to the lid 104.

The cooler 100 can have a single handle arm 112, two handle arms 112, or more than two handle arms 112. For a handle assembly 110 having multiple handle arms 112, one handle arm 122 can have the same or different size, shape, and/or dimensions as the other handle arm(s) 112. In addition to, or instead of, the handle arm 112 being rotatably coupled to the body 102, the handle arm 112 can be coupled to the body 102 in certain other ways, including but not limited to fixedly, slidably, removably, and hingedly. In certain exemplary embodiments, the handle arm 112 is omitted from the handle assembly 110.

The exemplary handle arm 112 can include one or more securing mechanisms 114 for receiving, securing, and/or storing a hook 120. The securing mechanism 114 can be disposed on an outer-facing surface of the handle arm 112 (as shown in FIGS. 1A-C), on an inner-facing surface of the handle arm 112, and/or inside a portion of the handle arm 112 (such as a slot). The exemplary securing mechanism 114 includes one or more features that, when coupled with the hook 120, secure the hook 120 to the securing mechanism 114. For example, as shown in FIGS. 1A-C, the securing mechanism 114 is a notch positioned on the outer-facing surface of each handle arm 112.

In certain exemplary embodiments, each securing mechanism 114 and hook 120 have a friction fit with one another that occurs through close tolerances and/or the application of an uneven surface (e.g., bumps, detents) on the hook 120 and/or the securing mechanism 114. When the hook 120 is secured in the securing mechanism 114, an undesired rotation of the hook 120 can be prevented.

The exemplary handle 116 is mechanically coupled to the handle arm 112 at location 126. The handle 116 can be coupled to the handle arm 112 at any point along the handle 116 and/or along the handle arm 112. In this example shown in FIGS. 1A-C, each end of the handle 116 (called a handle end) is rotatably coupled to the proximal end of each of the handle arms 112 at location 126. The handle 116 can have one handle end, two handle ends, or more than two handle ends. The handle 116 can be mechanically coupled to the handle arm 112 in one or more of a number of ways, including but not limited to fixedly, rotatably, slidably, removably, and hingedly. In exemplary embodiments where the handle arm 112 is omitted from the handle assembly 110, the handle 116 is mechanically coupled to some other component of the cooler 100, such as the lid 104 and/or the body 102.

The exemplary hooks 120, 122 engage an object to allow the cooler to hang. Each hook 120, 122 can have one or more of a number of shapes and/or features. As a example, the exemplary hooks 120, 122 are curved, angled, and/or V-shaped. As another non-limiting example, the end of the hooks 120, 122 are pointed, smooth, rectangular, rounded, curved, and/or blunt. As yet another example, the surface of a hook 120, 122 is smooth, jagged, and/or include a gripping means, such as a non-slip coating. A hook 120, 122 can have a fixed shape or a flexible shape, where for example a user can change the shape of the hook 120, 122. The exemplary hook 120, 122 is made of plastic, metal, rubber, some other suitable material, or any combination thereof.

The exemplary handle assembly 110 includes one or more hooks 120, 122 that are mechanically coupled to one or more components of the handle assembly 110. More than one hook 120, 122 can be mechanically coupled to a single component (e.g., a handle arm 112, the handle 116) or multiple components of the handle assembly 110. For example, if the hooks are mechanically coupled to the handle 116, multiple configurations can exist, including, but not limited to, one hook 120 positioned in the center of the handle 116, a hook 122 positioned at one handle end, a hook 120, 122 positioned at each of two handle ends, and multiple hooks positioned along the handle 116.

The exemplary hooks 120, 122 of are mechanically coupled to the handle 116 and/or the handle arm 112 about an axis defined by a pivot point 124. Here, the pivot point 124 is at or substantially close to the longitudinal axis of the handle 116 at the handle end. If a hook 120, 122 is mechanically coupled to the handle 116 and the handle arm 112, then the pivot point 124 and the pivot point 126 can be the same pivot point. For example, as shown in FIG. 1A, each hook 120, 122 is rotatably coupled to the outer-facing surface of a handle arm 112 (and, indirectly, a handle end of the handle 116) at pivot point 124. In certain exemplary embodiments, the hooks 120, 122 rotate independently of each other and/or, if the handle 116 is rotatably coupled to the handle arms 112, independently of the handle 116. In either case, the range of rotation of the hooks 120, 122 can be limited by the securing mechanism 114. As another example, each hook 120, 122 is rotatably coupled between the handle 116 and the inner-facing surface of a handle arm 112. In such a case, the hooks 120, 122 rotate independently of each other and/or independently of the handle 116 and/or the handle arms 112. In either case, the range of rotation of the hooks 120, 122 can be limited by the securing mechanism 114. If a hook 120, 122 is mechanically coupled to the handle 116 and the handle arm 112, then pivot point 124 and pivot point 126 are the same, or substantially the same, pivot point.

FIGS. 1A-C shows the hooks 120, 122 independently rotatable and mounted on outer-facing surface of a handle arm 112 at pivot point 124. Specifically, the hooks 120, 122 rotate around an axis defined by pivot point 124. Further, the handle assembly 110 includes two handle arms 112 that are each rotatably coupled, at the distal end, to the body 102 at pivot point 111. Specifically, the handle arms 112 rotate around an axis defined by pivot point 111. In FIG. 1A, the handle assembly 110 extends upward, away from the lid 104. The hooks 120, 122 of the handle assembly 110 are rotated upward (in a position to engage or hook onto a fence, bar or other structure) so that each hook 120, 122 can be positioned over one or more objects and allow the cooler 100 to hang from the object by the hooks 120, 122.

In FIG. 1B, the hooks 120, 122 are each rotated downward until the hooks 120, 122 hit position stops that generally act as securing mechanisms 114. The hooks 120, 122 may each be rotated clockwise, counterclockwise, or in either direction to properly be secured by the securing mechanisms 114. The handle arms 112 remain in the same position relative to the body 102 in FIG. 1B compared to FIG. 1A. With the handle assembly 110 in the configuration shown in FIG. 1B, the cooler 100 is ready for carrying.

In FIG. 1C, the handle arms 112 are rotated downward until the handle 116 approximately contacts the body 102. As in FIG. 1B, the hooks 120, 122 remain disposed against the securing mechanisms 114. With the handle assembly 110 in this position, the cooler 100 is capable of being stored.

Figure 2:
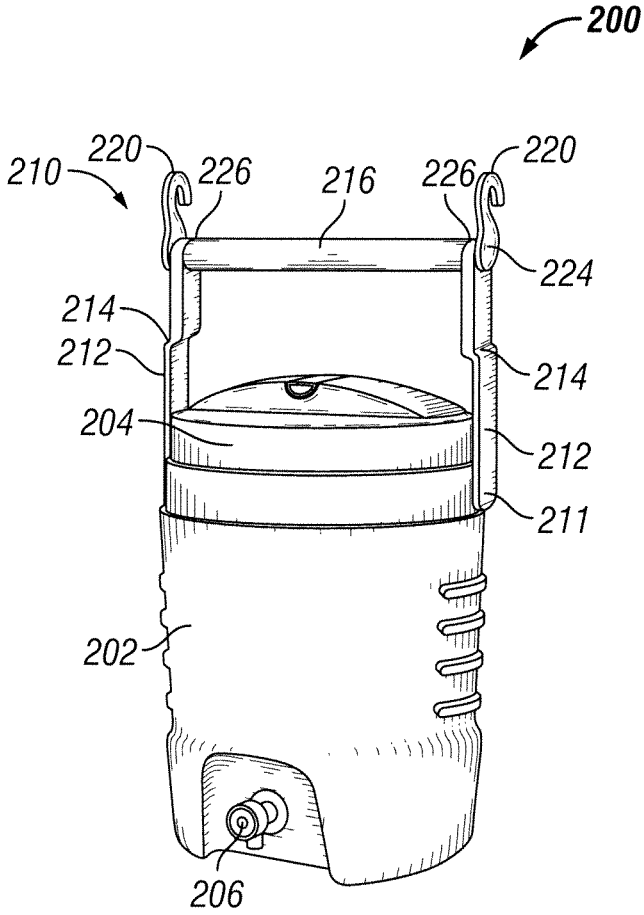
FIG. 2 is a perspective view of another exemplary cooler with storage hooks in accordance with certain exemplary embodiments.

FIG. 2 is a perspective view of an alternative cooler 200. Referring now to FIG. 2, the alternative cooler 200 is substantially the same as the cooler 100 of FIGS. 1A-C, except that the spout 206 is mechanically coupled to the bottom (the base) of the body 202 rather than on top of the lid 204.

Figure 3A:
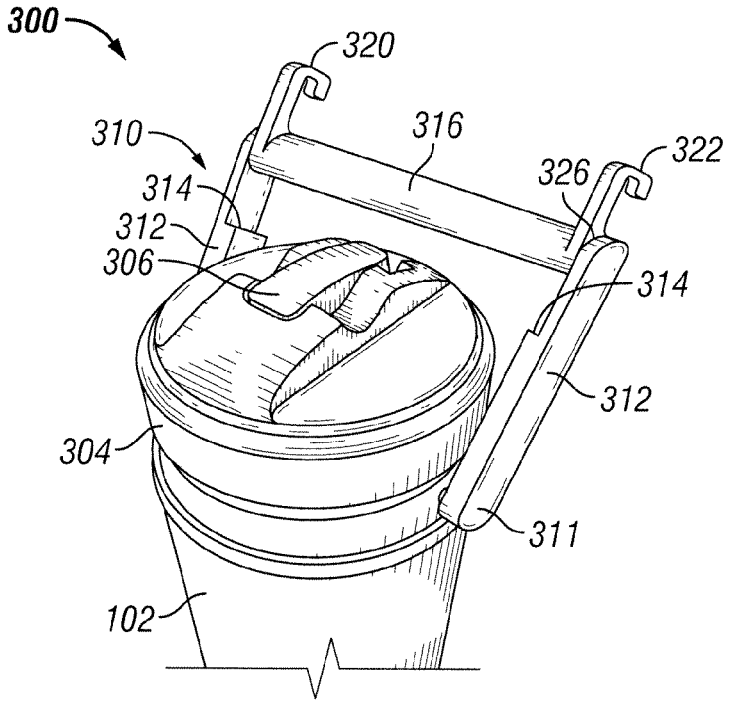
FIGS. 3A and 3B are perspective views of another exemplary cooler with storage hooks in accordance with certain exemplary embodiments.
Figure 3B:
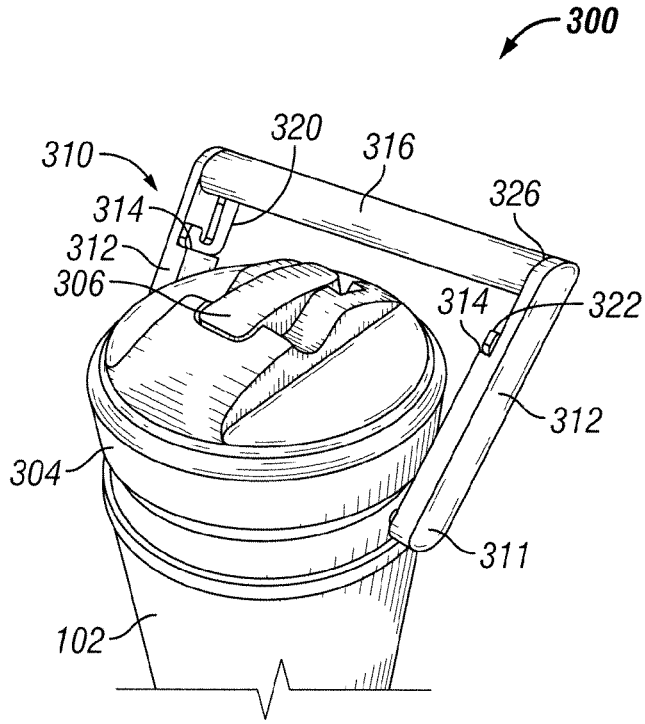

FIGS. 3A and 3B are partial perspective view of an alternative cooler 300 that uses exemplary storage hooks 320, 322 in accordance with certain exemplary embodiments. Referring to FIGS. 1 and 3, the body 102 is substantially the same as the body of the cooler 100 of FIGS. 1A-C. The lid 304 has a different spout 306 (in this case, a flip spout) positioned in a different location on the lid 304 compared to the cooler 100. As for the handle assembly 310, in this example, the hooks 320, 322 are fixedly coupled to the handle ends of the handle 316. For example, the hooks 320, 322 and the handle 316 shown in FIGS. 3A and 3B are integrally formed as a single plastic piece.

The combination handle 316 and hooks 320, 322 are rotatably coupled to the proximal ends 326 of the handle arms 312.

In such a case, the hooks 320, 322 are positioned adjacent to the inside-facing surface of the handle arms 312. Alternatively, the hooks 320, 322 are positioned adjacent to the outside-facing surface of the handle arms 312 if a portion of the handle 316 and/or the hooks 320, 322 extend through a portion of the handle arms 312 in such a way that allows the combination of the handle 316 and the hooks 320, 322 to rotate relative to the handle arms 312. Securing mechanisms 314 are positioned along the inside-facing surface or outside-facing surface of the handle arms 312 to act as position stops by engaging the hooks 320, 322 and limiting the rotation of the combination handle 316 and hooks 320, 322. In addition, the distal ends 311 of the handle arms 312 are rotatably coupled to the body 102.

In certain exemplary embodiments, the hooks 320, 322 are fixedly coupled to each other, and the hooks 320, 322 are also rotatably coupled to the handle 316 and/or the handle arms 312. For example, a pin (not shown) traverses a cavity within and along the length of the handle 316, where each end of the pin is fixedly coupled to a hook 320, 322. In such a case, the pin is able to rotate within the handle 316, causing the hooks 320, 322 to rotate.

In FIG. 3A, the handle assembly 310 extends upward, away from the lid 304. The combination handle 316 and hooks 320, 322 of the handle assembly 310 are rotated upward so that the hooks 320, 322 are positioned to engage or hook onto a fence, bar or other object or structure and allow the cooler 300 to hang from the object by the hooks 320, 322.

In FIG. 3B, the combination handle 316 and hooks 320, 322 are rotated downward until the hooks 320, 322 engage or contact the securing mechanisms 314. The combination handle 316 and hooks 320, 322 may each be rotated clockwise, counterclockwise, or in either direction to properly engage the securing mechanisms 314. The handle arms 312 remain in the same position relative to the body 102 in FIG. 3B compared to FIG. 3A. With the handle assembly 310 in the configuration shown in FIG. 3B, the cooler 300 is ready for carrying.

Figure 4:
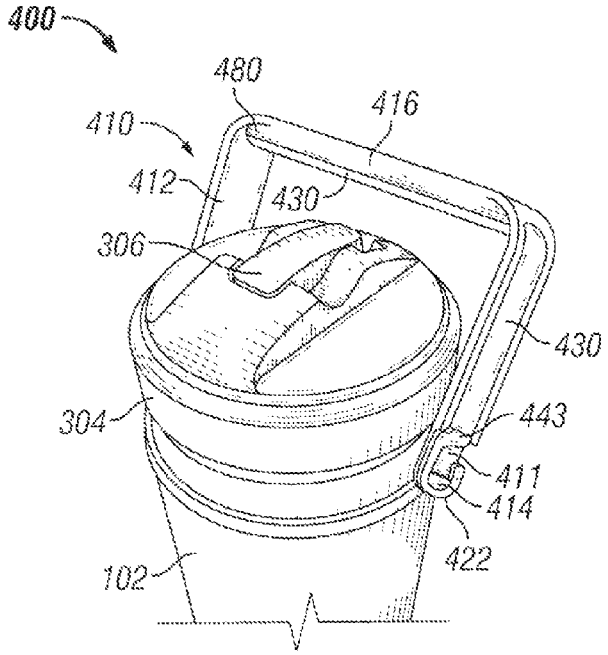
FIG. 4 is a perspective view of an exemplary cooler with storage hooks in accordance with certain exemplary embodiments.

FIG. 4 is a partial-perspective view of another alternative cooler 400 that includes storage hooks 420, 422 in accordance with certain exemplary embodiments. Now referring to FIGS. 1, 3, and 4, the body 102, lid 304, and spout 306 are substantially similar to the corresponding components described above with respect to FIGS. 3A and 3B. As for the handle assembly 410, the proximal end of the handle arms 412 and the handle ends of the handle 416 are fixedly coupled to each other. For example, the handle arms 412 and the handle 416 shown in FIG. 4A are integrally formed from a single plastic piece.

The exemplary handle assembly 410 includes a strap 430. The strap 430 is mechanically coupled to the hook 422. The strap 430 can be rigid or flexible and can have a fixed or adjustable length. The strap 430 can be mechanically coupled to one hook 422 or multiple hooks. For example, while not shown, the other end of the strap 430 is mechanically coupled to a second hook, which is positioned along the opposing handle arm 412. The strap 430 can be removable, slidably, and/or fixedly coupled to the combination of the handle 416 and the handle arms 412. The strap 430 can be made of one or more of a number of materials, including but not limited to rubber, nylon, plastic, and neoprene.

The strap 430 can be part of, or be a separate component from, the handle 416. If the strap 430 is a separate component from the handle 416, then the strap 430 traverses the length of part or all of the handle 416. In such a case, the strap 430 is secured to the handle 416 using one or more of a number of securing mechanisms, including but not limited to one or more tabs, a slot, a groove, one or more raised sides of the handle 416, and a cavity. Such a securing mechanism can be located at any point on and/or within the handle 416. The strap 430 can also be mechanically coupled to some portion (e.g., a handle end) of the handle 416. In such a case, the distal end of the strap 430 is coupled to the handle 416 in one or more of a number of ways, including fixedly, removably, rotatably, hingedly, and slidably.

In certain exemplary embodiments, the strap 430 is mechanically coupled to each hook 422 along a longitudinal end 443 of the strap 430. The strap 430 can be coupled to the hook 422 in one or more ways, including, but not limited to, fixedly, rotatably, and slidably coupled. The hook 422 is removably secured to the handle or handle arm 412 using a securing mechanism 414. In the example shown in FIG. 4, the securing mechanism 414 is a protrusion that extends out from the surface of the handle arm 412 at a position that is near the distal end of the handle arm 412. Each hook 422 engages its respective protrusion by having the curved portion of the hook 422 disposed around all or a portion of the protrusion. If the strap 430 is flexible, then the location of the protrusion along the handle arm 412 results in putting the strap 430 in tension when the hook 422 is engaged with the protrusion, thus keeping the hook 422 engaged with the protrusion.

Further, the strap 430 can be secured by the handle arm 412 in certain exemplary embodiments. For example, as shown in FIG. 4, the outer-facing surface of the handle arm 412 can have a slot along its length that provides a friction fit with the strap 430 when the strap 430 is positioned within the slot. As another example, the handle arm 412 can have one or more other securing devices, such as a clip, a groove, and a cavity, that can secure all or a portion of the strap 430.

In certain exemplary embodiments, the handle arms 412 have one or more apertures through which the strap 430 traverses to be secured by or held in engagement with the handle 416. For example, adjacent to each handle end 480 where the handle transitions to the handle arm in FIG. 4, the proximal end of the handle arm 412 has an aperture through which the strap 430 traverses to be secured by the slot along the length of the underside of the handle 416. In certain exemplary embodiments, the strap 430 is rigid and is hingedly coupled to the handle end of the handle 416 and/or to the proximal end of the handle arm 412.

The handle ends 480 are fixedly coupled to the proximal end of the handle arms 412. The distal ends 411 of each handle arm 412 is rotatably coupled to the body 102 at pivot point 411. The cooler 400 shown in FIG. 4 may have only a single handle 422 and strap 440. Alternatively, an additional handle and strap may be hidden from view by the handle arm 412 on the far side of the cooler 400.

Figure 5:
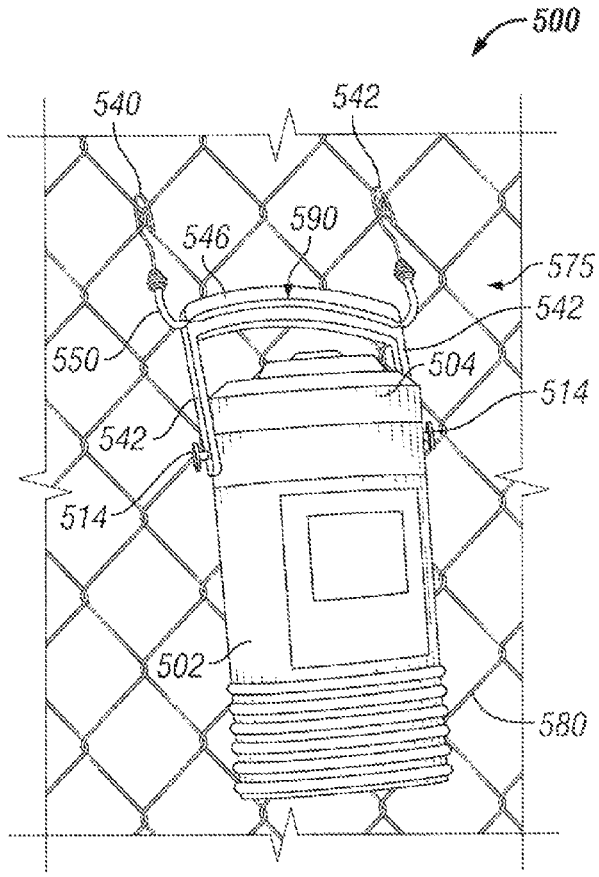
FIG. 5 is a perspective view of an alternative exemplary cooler with storage hooks in accordance with certain exemplary embodiments.

FIG. 5 is a perspective view of the exemplary cooler 500 having a handle assembly 575 with storage hooks 540, 542 according to certain exemplary embodiments. The exemplary cooler 500 of FIG. 5 is substantially similar to the cooler 400 of FIG. 4 and only the differences will be discussed herein. In this exemplary cooler 500, the hooks 540, 542 are engaged with an object 580 in the form of a chain-link fence. The strap 550 is a bungee cord that traverses a slot 590 that runs along the entire length of the front side of the handle 546 and secures the strap 550. The strap 550 is also disposed through apertures in the side of the proximal end of each handle arm 542, which is fixedly coupled to the handle 546. The distal end of each handle arm 542 is rotatably coupled to the body 502 and includes a securing mechanism 514 in the form of a protrusion that extends out from an outwardly facing surface of the respective handle arm 542 and around which the curved part of the hooks 540, 542 can be disposed. The cooler 500 includes a lid 504 that is rotatably coupled to the body 502.

Figure 6:
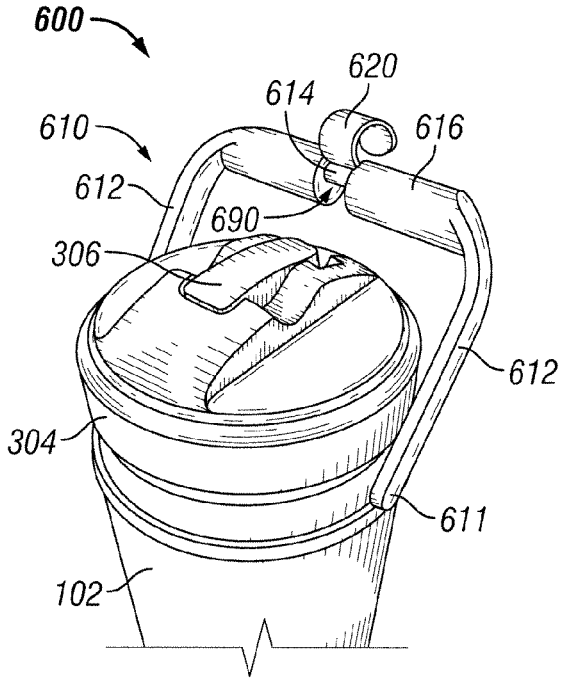
FIG. 6 is a perspective view of yet another exemplary cooler with storage hooks in accordance with certain exemplary embodiments.

FIG. 6 is a partial-perspective view of yet another alternative cooler 600 having an storage hook 620 according to certain exemplary embodiments. Referring to FIGS. 1, 3, and 6, the exemplary cooler 600 includes a handle 616 fixedly coupled to the handle arms 612. Each handle arm 612 is rotatably coupled to the body 102 near a distal end 611 of the arm 612. The handle assembly 610 includes a hook 620 that rotates around a portion of the length of the handle 616 at a pivot point 690. In certain exemplary embodiments, the pivot point 690 is substantially the center of the longitudinal length of the handle 616. Located adjacent to the hook 620 at pivot point 690 is a securing mechanism 614. In this case, the securing mechanism 614 is a notch that uses a friction fit to receive and secure the hook 620 when the hook 620 rotates clockwise toward the securing mechanism 614.

In certain exemplary embodiments, the handle 616 has multiple hooks 620 positioned along the length of the handle 616. For example, in addition to the exemplary embodiment shown in FIG. 6, a single hook 620 can be positioned at a handle end, two hooks 620 can be positioned at each handle end, two hooks 620 can be located at various parts along the length of the handle 616, and three hooks 620 can be positioned along the length of the handle 616.

Figure 7:
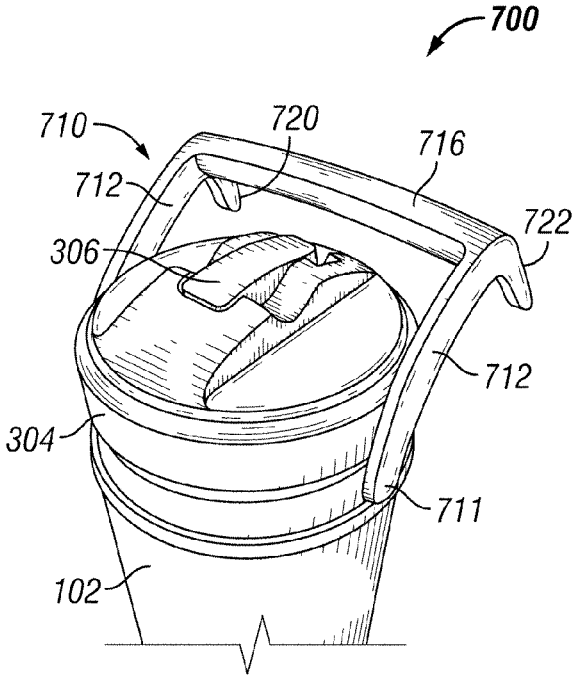
FIG. 7 is a perspective view of still another exemplary cooler with storage hooks in accordance with certain exemplary embodiments.

FIG. 7 is a partial-perspective view of another alternative embodiment for a cooler 700 with a storage hook 720 according to certain alternative exemplary embodiments. Referring now to FIGS. 1, 3, and 7, the exemplary cooler 700 includes a handle 716 coupled on opposing ends to a pair of handle arms 712 at one end (or handle end) of each respective handle 716 with opposing handle ends. Each handle end is fixedly coupled to the proximal end of a handle arm 712 and fixedly coupled to one of the hooks 720, 722. In addition, a point on each of the arms 712 substantially near the distal ends 711 of the handle arms 712 is rotatably coupled to the body 102. The hooks 720, 722 are secured by rotating the handle assembly 710 clockwise until the handle 716 contacts the body 102.

Figure 8:
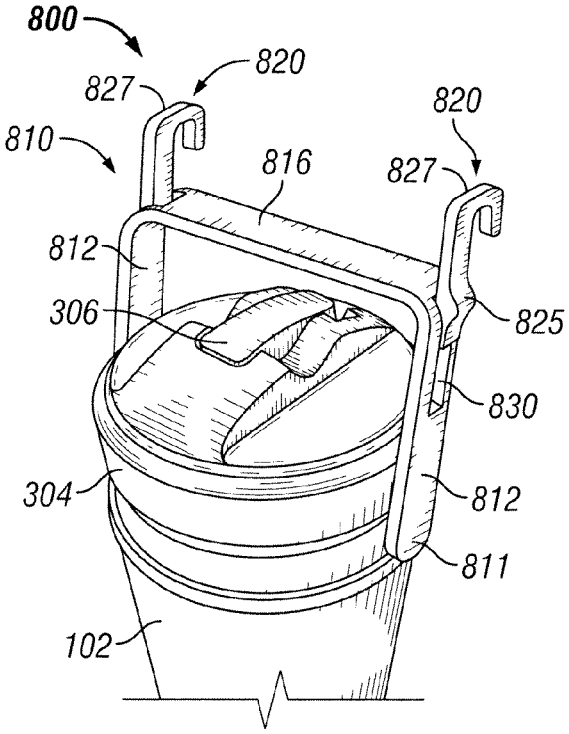
FIG. 8 is a perspective view of yet another exemplary cooler having storage hooks in accordance with certain exemplary embodiments.

FIG. 8 is a perspective view of a cooler having exemplary storage hooks in accordance with certain exemplary embodiments. Referring to FIGS. 1, 3, and 8, the exemplary handle assembly 810 of FIG. 8 is mechanically coupled to the body 102 of the cooler 800. Specifically, the handle assembly 810 is rotatably coupled to the body 102 near a distal end 811 of the handle assembly. The handle assembly 810 includes a handle 816 that is fixedly coupled to the handle arms 812 at each of the handle ends. Hooks 820, which include a securing portion 827 and an actuator 825, are slidably adjustable within the handle arms 812. Specifically, the handle arms 812 have a slotted cavity 830 that has slightly larger dimensions (e.g., length, width, height) than the corresponding dimensions of the hook 820 for the portions of the hook 820 that are positioned inside of the slotted cavity 830. The slots and/or receiving portions of the slotted cavity 830 correspond to the receiving portions and/or the slots of the hook 820 to allow the hook 820 to slide within at least a range of the slotted cavity 830. In the example shown in FIG. 8, the hooks 820 are fully extended because the hooks 820 are positioned at the highest portion of the slotted cavity 830.

The hook 820 slides within the slotted cavity 830 using the actuator 825. Specifically, a user presses inward (compressible) and/or applies force to the actuator 825 in the direction that the user wants the hook 820 to slide within the slotted cavity 830. In this example, the actuator 825 is fixedly coupled to the securing portion 827 of the hook 810. The actuator 825 can be part of the hook 820 or a separate piece that is mechanically coupled to the hook 820. The actuator 825 can be made of one or more of a number of materials, including, but not limited to, plastic, rubber, nylon, compressible silicone, and metal. The actuator 825 can be made of the same or different material than the rest of the hook 820.

The slotted cavity 830 and/or the hook 820 can have one or more features to allow the hook 820 to stop at certain positions (e.g., fully extended, fully retracted) within the slotted cavity 830. Examples of such features include, but are not limited to, bumps, detents, a spring-locking mechanism, friction fittings, and uneven surfaces. Each exemplary hook 820 is positioned within its corresponding slotted cavity 830 independent of the other hooks 820. In certain exemplary embodiments, the slotted cavity 830 is positioned within the handle 816 rather than the handle arm 812.

Figure 9A:
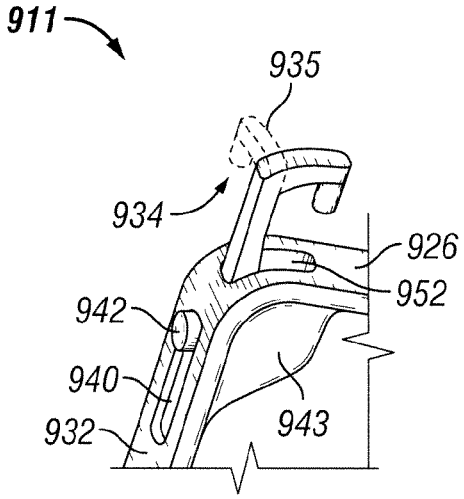
FIGS. 9A and 9B are various views of still another exemplary cooler having storage hooks in accordance with certain exemplary embodiments.
Figure 9B:
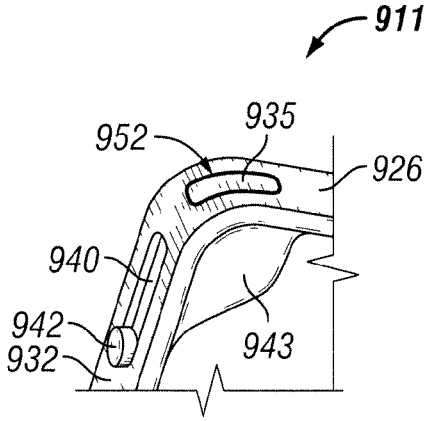

FIGS. 9A and 9B are partial-perspective views of a portion of a different exemplary handle assembly 911 for a cooler. Referring to FIGS. 9A and 9B, the exemplary handle arm 932 is fixedly coupled to the handle 926. At or near the pivot point of the fixed coupling, there is also a cavity 943 positioned on the underside of the handle 926 and the handle arm 932. The cavity 943 houses the securing portion 935 of the hook 934. The securing portion 935 of the hook 934 protrudes through and is retracted into the cavity 943 through an aperture 952 shaped in a manner that allows the securing portion 935 to pass therethrough.

In certain exemplary embodiments, the securing portion 935 of the hook 934 is rotatable to direct the securing portion 935 relative to the object upon which the hook 934 hangs. For example, as shown in FIG. 9A, the securing portion 935 is rotated approximately 90° counter-clockwise after the securing portion 935 is fully extended from the cavity 943. In such a case, the securing portion 935 can freely rotate, rotate within a range, rotate in one or more of a number of discrete positions, rotate in some other suitable manner, or any combination thereof. As shown in FIG. 9B, when the securing portion 935 is fully retracted within the cavity 943, the top of the securing portion 935 is positioned substantially flush with the top surface of the handle 926 within the aperture 952.

In certain exemplary embodiments, the cavity 943 is omitted from the handle assembly 911. In such a case, the securing portion 935 of the hook 934 retracts into and extends away from a cavity within the handle arm 932. In any case, the slot 940 may have one or more positions in which the actuator 942 can be positioned. For example, the slot 940 can have a closed position when the actuator 942 is positioned at the bottom end of the slot 940, in which case the securing portion 935 of the hook 934 is fully retracted. As another example, the slot 940 can have an open position when the actuator 942 is positioned at the top end of the slot 940, in which case the securing portion 935 of the hook 934 is fully extended.

The actuator 942 of the hook 934 slides within the slot 940 positioned on the outer-facing surface of the handle arm 932. Specifically, a user presses inward (compressible) and/or applies force to the actuator 942 in the direction that the user wants the actuator 942 (and thus the securing portion 935 of the hook 934) to slide within the slot 940. The actuator 942 can be part of the hook 934 or a separate piece that is mechanically coupled to the hook 934. The actuator 942 can be made of one or more of a number of materials, including but not limited to plastic, rubber, nylon, and metal. The actuator 942 can be made of the same or different material than the rest of the hook 934.

The slot 940 and/or the actuator 942 can have one or more features to allow the actuator 942 to stop at certain positions (e.g., fully extended, fully retracted) within the slot 940. Examples of such features include, but are not limited to, bumps, detents, a spring-locking mechanism, friction fittings, and uneven surfaces. Each actuator 942 for a hook 934 can be positioned within its corresponding slot 940 independent of the actuators 942 for other hooks 934. In certain exemplary embodiments, the slot 940 is positioned on the handle 926 rather than the handle arm 932.

Figure 10A:
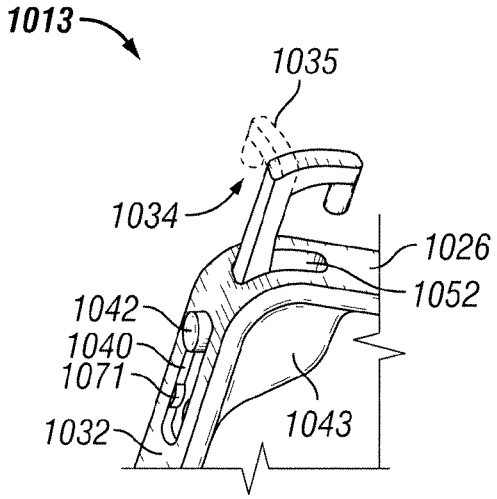
FIGS. 10A and 10B are various views of yet another exemplary cooler having storage hooks in accordance with certain exemplary embodiments.
Figure 10B:
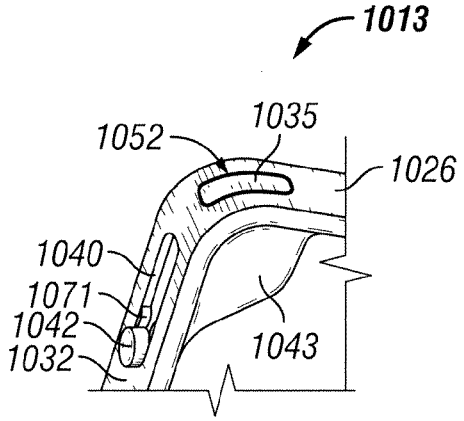

FIGS. 10A and 10B are partial-perspective view of a portion of a different exemplary handle assembly 1013 for a cooler. Referring to FIGS. 10A and 10B, the handle assembly 1013 is substantially the same as the handle assembly 911 of FIGS. 9A and 9B, except that the slot 1040 includes a locking feature 1071 in the form of hard bumps, detents, or protrusions to hold the actuator 1042 in one or more positions within the slot 940.

Exemplary embodiments described herein allow a cooler to hang from an object rather than sit on the ground. As a result, the cooler is not subject to getting knocked over while on the ground, avoids sitting in mud and dirt, and can avoid being an obstacle in a walkway. The exemplary integrated retractable storage hooks described herein allow the cooler to be safely moved, carried, and/or stored when the hooks are not in use.

What is claimed is:

1. A cooler comprising:

a body comprising a bottom and at least one wall forming a cavity;

a lid removably coupled to the at least one wall;

a spout coupled to the lid; and a handle assembly coupled to the body, the handle assembly comprising:

at least one handle arm comprising a distal end and a proximal end, wherein the distal end is coupled to the body;

a handle comprising a handle end coupled to the proximal end of the at least one handle arm; and at least one hook coupled to the handle, wherein the at least one handle arm comprises a securing mechanism for receiving the at least one hook, and wherein the at least one hook is rotatably coupled to the handle end and an outer-facing surface of the proximal end of the at least one handle arm, and wherein the securing mechanism is positioned on the outer-facing surface of the at least one handle arm.

2. The cooler of claim 1, wherein the securing mechanism is a notch in the at least one handle arm.

3. A cooler comprising:

a body comprising a bottom and at least one wall defining a cavity; and a lid removably coupled to the at least one wall and comprising:

a lid base;

at least one handle arm comprising a distal end and a proximal end, wherein the distal end is coupled to the lid base;

a handle comprising a handle end coupled to the proximal end of the at least one handle arm;

at least one hook mechanically coupled to the handle; and a spout coupled to the lid, wherein the at least one handle arm comprises a securing mechanism for receiving the at least one hook, and wherein the at least one hook is rotatably coupled to the handle end and an outer-facing surface of the proximal end of the at least one handle arm, and wherein the securing mechanism is positioned on the outer-facing surface of the at least one handle arm.

4. A cooler comprising:

a body comprising a bottom and at least one wall forming a cavity;

a lid removably coupled to the at least one wall;

a spout coupled to a lower portion of the body; and a handle assembly coupled to an upper portion of the body, the handle assembly comprising:

at least one handle arm comprising a distal end and a proximal end, wherein the distal end is coupled to the upper portion of the body;

a handle comprising a handle end coupled to the proximal end of the at least one handle arm; and at least one hook coupled to the handle, wherein the at least one handle arm comprises a securing mechanism for receiving the at least one hook, and wherein the at least one hook is rotatable coupled to the handle end and an outer-facing surface of the proximal end of the at least one handle arm, and wherein the securing mechanism is positioned on the outer-facing surface of the at least one handle arm.

5. The cooler of claim 4, wherein the securing mechanism is a notch in the at least one handle arm.

6. The cooler of claim 3, wherein the securing mechanism is a notch in the at least one handle arm.

7. The cooler of claim 1, wherein the at least one handle arm comprises two handle arms.

8. The cooler of claim 1, wherein the securing mechanism and the corresponding at least one hook are in friction fit when then securing mechanism receives the corresponding at least one hook.

9. The cooler of claim 8, wherein at least one of the securing mechanism or the at least one hook comprise an uneven surface.

10. The cooler of claim 1, wherein the at least one hook comprises a plurality of hooks, at least one hook being rotatable independently from at least one other hook.

11. The cooler of claim 1, wherein at least one hook is rotatable in a clockwise direction.

12. The cooler of claim 1, wherein at least one hook is rotatable in a counterclockwise direction.

13. The cooler of claim 3, wherein the at least one handle arm comprises two handle arms.

14. The cooler of claim 3, wherein the securing mechanism and the corresponding at least one hook are in friction fit when then securing mechanism receives the corresponding at least one hook.

15. The cooler of claim 14, wherein at least one of the securing mechanism or the at least one hook comprise an uneven surface.

16. The cooler of claim 3, wherein the at least one hook comprises a plurality of hooks, at least one hook being rotatable independently from at least one other hook.

17. The cooler of claim 3, wherein at least one hook is rotatable in a clockwise direction.

18. The cooler of claim 3, wherein at least one hook is rotatable in a counterclockwise direction.

19. The cooler of claim 4, wherein the at least one handle arm comprises two handle arms.

20. The cooler of claim 4, wherein the securing mechanism and the corresponding at least one hook are in friction fit when then securing mechanism receives the corresponding at least one hook.

21. The cooler of claim 20, wherein at least one of the securing mechanism or the at least one hook comprise an uneven surface.

22. The cooler of claim 4, wherein the at least one hook comprises a plurality of hooks, at least one hook being rotatable independently from at least one other hook.

23. The cooler of claim 4, wherein at least one hook is rotatable in a clockwise direction.

24. The cooler of claim 4, wherein at least one hook is rotatable in a counterclockwise direction.

* * * * *